United States Patent [19]

Nakaoka et al.

[11] 4,040,873

[45] Aug. 9, 1977

[54] METHOD OF MAKING LOW YIELD POINT COLD-REDUCED STEEL SHEET BY CONTINUOUS ANNEALING PROCESS

[75] Inventors: Kazuhide Nakaoka; Kenji Araki, both of Yokohama, Japan

[73] Assignee: Nippon Kokan Kabushiki Kaisha, Tokyo, Japan

[21] Appl. No.: 629,525

[22] Filed: Nov. 6, 1975

[30] Foreign Application Priority Data

Aug. 23, 1975 Japan ..... 50-102283

[51] Int. Cl.[2] ..... C21D 9/48

[52] U.S. Cl. ..... 148/12 C; 148/12.3

[58] Field of Search ..... 148/12 C, 12.3

[56] References Cited

U.S. PATENT DOCUMENTS

| | | | |
|---|---|---|---|
| 3,248,270 | 4/1966 | Laidman et al. | 148/12 C |
| 3,839,095 | 10/1974 | Kubotera et al. | 148/12 C |
| 3,865,645 | 2/1975 | Takahashi et al. | 148/12.3 |

*Primary Examiner*—W. Stallard

*Attorney, Agent, or Firm*—Flynn & Frishauf

[57] ABSTRACT

A low yield point cold-reduced steel sheet having excellent properties for press-forming can be obtained by a full continuous annealing process when a low carbon steel is manufactured by:

1. chemical composition is substantially controlled at the steel making stage as follows,
   $[O_2] \leqq 0.02\%$, preferably 0.014%, depending upon additions of Si and Al,
   $[Si] \leqq 0.2\%$, preferably 0.1% to 0.02%,
   $[Sol.Al] \leqq 0.009\%$, preferably 0.005%,
2. at the hot-rolling stage after ordinary slabbing, a hot-rolled steel strip is coiled within the range of 650° C to 800° C, and
3. at the continuous annealing stage after ordinary pickling - cold-reducing, a cold-reduced steel strip is subjected to a full continuous annealing including an over-aging treatment.

4 Claims, No Drawings

METHOD OF MAKING LOW YIELD POINT COLD-REDUCED STEEL SHEET BY CONTINUOUS ANNEALING PROCESS

DETAILED DESCRIPTION OF THE INVENTION

The present invention concerns an improvement for drawability of low carbon cold-reduced steel sheet by a continuous annealing process, and more particularly it aims at providing high grade press-formability to the steel sheet by full continuous annealing.

Generally speaking, a low carbon cold-reduced steel sheet for high grade press-forming purposes which are called deep-drawing or super deep-drawing and also those for general press forming purposes are manufactured in accordance with the so-called batch-type annealing process. It has been demanded for many years in the industry concerned as well as in related fields to manufacture such soft steel strips by a continuous annealing process in view of the productivity and uniformity of materials. Continuous research has been carried out for the development of such an art, which in recent years has borne fruit in practice in Japan. Examples of such results have been disclosed in Japanese Patent Publications No. 1969/74 and 1341/75. These are characterized uniquely and their details differ from each other, but they are common to each other in respect of the following points:

1. an ordinary low carbon steel for cold reduced steel sheet is used as the material;
2. the strip is coiled at a high temperature of 630° C or above 630° C at hot rolling stage;
3. the strip is subjected to a full continuous annealing process including overaging treatment with the heating cycle of "recrystallization heating — quenching — short period over-aging treatment for precipitating [C] in steel — cooling down to the room temperature."

A combination selected from these manufactures facilitated the so-far-regarded-impossible manufacture of a cold-reduced steel sheet for general press-forming by continuous annealing. However, the press formability obtained in this art naturally had its limitations. General press formability obtained was quite sufficient, but it was impossible to obtain a steel having sufficiently high grade press formability with a yield point of less than 20 kg/mm$^2$ as required of the usual state of steels. Thus, further efforts for development were demanded. The present situation is such that these steels are regarded as much less inferior to the batch-type annealed steels. If there were an available art which might facilitate production of the types of steels which so far had to be manufactured by said batch-type annealing process, e.g., a low yield point-low carbon steel sheet often used for the outer shell of an automobile body, by a continuous annealing, such an art would prove most advantageous and significant industrially.

The present invention was directed to this very object, and is fundamentally characterized in that [$0_2$], [Si] and [Sol.Al] in steel are controlled to be of optimum values, and the coiling temperature at hot rolling stage is accurately selected. The synergistic effects of these two factors cooperate to provide grain growth during recrystallization heating in a continuous annealing process.

An object of this invention is to provide a low carbon steel sheet having a low yield point, e.g., less than 20 Kg/mm$^2$, by a full continuous annealing process.

Another object of this invention is to give high grade press formability to a cold-reduced steel by the continuous annealing process independent of the known batch-type annealing process.

A further object of this invention is to manufacture a low carbon steel sheet having high grade press formability with high productivity and excellent uniformity of material quality.

Other objects and advantages of this invention will be apparent from the following description.

It is fundamental technical knowledge to encourage grain growth during annealing and to enlarge the crystal grains in the finished product and in order to lower the yield point of a steel. One measure taken for realizing such a grain growth is to reduce as much as possible the number of fine second phase particles in steel which act toward the direction interrupting such growth. According to a number of experiments which we have carried out, undesirable influences on grain growth by such second phase articles became particularly apparent in a continuous annealing process. Naturally, this is caused by the extremely short period of recrystallization-heating time in a continuous annealing process. Therefore, such a type of controls on the annealing requirements as in the case of batch type annealing are hardly feasible. In pursuing the said second phase particles in the light of such experiments, oxide type inclusions, AlN precipitates and carbide were found to have acted undesirably on the crystal grain growth. It was found further that the method for avoiding such undersirable influences was only to reduce the absolute value of these fine particles or to enlarge their sizes. Then, the grain growth would be improved greatly even in a short time process as continuous annealing, and the desired low yield point might be given to a steel strip. The present invention was developed based on the above mentioned findings obtained through numerous experiments. However, it was confirmed that the composition of the steels of this invention and the coiling requirements in hot rolling stage, discussed hereinafter, are such that the cold reduced steel strip obtained by such requirements would not show the desired effects even if annealed by the conventional batch type method. In other words, the desired effects failed to appear or appeared only very slightly. This is because the annealing of at least 2 to 3 hours in the batch type process is sufficient to move its grain boundary, overcoming obstruction of the said fine second phase particles which are a determinant on quality of steel during the extremely short time period of continuous annealing. Specially in a case of carbide, the solution, diffusion and re-precipitation of carbon enable the carbide to move as well as the grain boundary. There are no bad influences thereby. Such an obstruction by and undesirable influences of the fine second phase particles are a phenomenon unique in a continuous annealing process, and they can be stably obviated by the process of the present invention.

What should be done first to eliminate the undesirable effects of the above-mentioned fine second phase particles is a careful control over the composition thereof. That is to say, carbon [C] and the others may be contained in percentages normal for a low carbon steel for cold-reducing, but oxygen [$O_2$] should be controlled to be $\leqq$ 0.02%, and preferably $\leqq$ 0.014%; silicon [Si], $\leqq$ 0.2%, preferably 0.1 to 0.02%; and soluble aluminum [Sol.Al], $\leqq$ 0.009%, preferably $\leqq$ 0.005%. These [$O_2$], [Si] and [Sol.Al] contents are the bases which facilitate obviating the detrimental influences of the fine second phase particles in a continuous annealing process, as has been discussed above. Further elaborating the reasons for such a control, the following is provided.

Oxygen [$O_2$] is known to exist in a steel as oxide type fine inclusions with Fe, Mn, Si and Al. Even if the undesirable effect of carbide were to be obviated by a high coiling temperature in a hot rolling stage, when annealing at a short time period performed as in a continuous annealing, the appearance of very undesirable influences against grain growth of these oxide type fine inclusions becomes unavoidable; that is, the amount of [$O_2$] in ordinary low carbon steel is left just as it is. Accordingly, the amount of [$O_2$] should be controlled up to 0.02% maximum in steel to prevent detrimental effects of continuous annealing. If the content is reduced to 0.14% or less in view of the industrial stability, it will become possible to remove the undesirable effects of the said second phase fine particles stably.

Various other conventional means have been used to perform such deoxidations as with Si and/or Al, processing with degassing facilities, and simultaneous use of the above-mentioned deoxidation and degassing means. Any one of these means may be used as one process in the present invention, provided that cost is no object. However, deoxidation with Si, Al may be called most common because it requires no special facilities of its own nor any excessive cost. In any case, [$O_2$] should be within the above-mentioned range and [Si] and [Sol.Al] should be rigidly controlled; the reasons are discussed below.

The amount of [Si] in steel should be 0.2% or less, and preferably it should be controlled to be 0.1% to 0.02%. Thus, silicon is used as a deoxidation agent as above mentioned. If [Si] in steel after deoxidation exceeds 0.2%, recrystallized grains after continuous annealing were found to become extremely fine and not meeting the purposes of the present invention. This is considered to have been caused by very fast recrystallization heating in continuous annealing, in addition to the fact that [Si] has a strong solution hardenability. The result of such experiments suggests that [Si] content in the deoxidized steel should be kept as low as possible. However, it was also found that [Si] amounts lower than 0.02% would render the control of the said [$O_2$] content difficult. Accordingly, Si content in steel should be 0.2% maximum and 0.02% minimum. The preferred range is set between 0.1% and 0.02%.

Acid soluble aluminum in steel is 0.009% or less, and preferably 0.005% or less. This is also added as a deoxidizing agent as in the case of silicon. [Sol.Al] after deoxidation remains as AlN precipitates; but, as mentioned above, this exerts a most undesirable influence on material quality, which is strong beyond that of said batch-type annealing process, if the steel is coiled at a high temperature in the hot rolling stage and subjected to a continuous annealing. Therefore, [Sol.Al] content of the steel should be controlled with utmost care. 0.009% of such [Sol.Al] would tentatively achieve the object, but when the content is controlled to 0.005% or less, it is quite easy to remove the above-mentioned undesirable effects completely.

Except for the above-mentioned controls on [$O_2$], [Si] and [Sol.Al] contents, there is no limitation placed on the components of the steel. In other words, the normal composition for low carbon cold reduced steel may be used; that is, [C] 0.03 to 0.10%; [Mn] 0.10 to 0.60%; [P] 0.04% or less; [S] 0.03% or less; and [$N_2$] 0.001 to 0.008%. If the actual composition is selected from within the range as mentioned above, there is no obstacle in achieving the objects of the present invention. In other words, what is generally known and recognized of the manner of influences by these elements is applied to the present invention. For instance, a smaller [Mn] content is preferable for $\bar{r}$ value, smaller [P] and [S] contents improve ductility, and a lower [$N_2$] content improves the strain aging property.

Controlling the chemical composition as mentioned above is a fundamental and primary feature of the present invention. The ensuing process can be either the ordinary ingot making method or the continuous casting method. The slab thus obtained is hot rolled into a hot strip. There are no specific conditions for hot rolling and the ordinary requirements used (i.e., high finishing temperature at above 800° C) will suffice. However, there is a requirement to be kept in coiling the hot strip obtained, and this constitutes a second cooperative feature of this invention.

The hot strip finished at a high temperature of above 800° C is coiled at 650° C to 800° C. The reason for such a high coiling temperature is to remove undesirable influences caused by carbide in steel. That is to say, when the coiling temperature as above-mentioned exceeds 650° C, carbide becomes distributed roughly in steel and almost completely removes the interruption of carbide against themoving of grain boundary. As a result, an excessive effect of the second phase particles other than carbides, that is, the said oxide and AlN begin to appear. In other words, the effect of the high coiling temperature is greater in steel compositions of the present invention than those of ordinary steels. On the other hand, if the said coiling is performed at a temperature lower than 650° C, desired properties depending upon a full continuous annealing cannot develop. This is because the fine carbide appearing in the case of the above-mentioned low temperature coiling controls its grain growth. However, although high temperature coiling is preferred, coarse grains for a hot-rolled strip unavoidably appear if the temperature is raised to above 800° C. Such a coarse grain strip brings out the so-called orange-peel through press forming after cold-reducing. In the present invention steel of which grain growth is improved by controlling the above-mentioned composition, the said trend appears excessively. Therefore, the coiling temperature at hot rolling stage should suitably be selected within the range of 650° C to 800° C. There are no specific limitations placed on the pickling — cold reducing for the hot rolled strip thus coiled, and ordinary conditions will suffice. A third cooperative feature of the present invention lies in the ensuing full continuous annealing process.

In order to achieve the marked effects of the composition prepared in accordance with the present invention and coiled at a high temperature, the steel should be treated by a full continuous annealing process including an overaging step. A batch-type annealing process or the simple continuous annealing process would not achieve the effect of the present invention, because there is sufficient time for grain growth in a batch-type annealing process so that by making the annealing requirements somewhat severe said grain growth is easily obtainable without giving much consideration to the composition or coiling as in the case of the present invention. In the simple continuous annealing, a great amount of solute carbon impairs quality of material, consequently the influence by crystal grain size is covered up. Therefore, the strip prepared of the abovementioned composition, coiled at a high temperature and then cold rolled should be treated with a full continuous annealing process including an over-aging step. Only through the above steps can be desired effects of this invention be obtained with ease and stability. In this case, the heating cycle of the above annealing process may be allowed to be somewhat different. What is meant here by a full continuous annealing process including an over-aging step is an annealing cycle comprising recrystallization heating to the range of 680° to 900° C for 30 to 180 seconds, rapid-cooling to below 500° C at a speed of 10° C/second or above, over-aging treatment for 30 to 600 seconds within the temperature range of 350° to 500° C, and finally cooling down to room temperature (about 20° C) and coiling. By way of caution, a low carbon steel sheet having a low yield point of 20 Kg/mm$^2$ or les is impossible to obtain only by the above-mentioned annealing process. That is, only the combined process comprising substantially the controlled chemical composition, the coiling step at high temperture, and the full continuous annealing step including over-aging treatment, can provide a steel strip of high grade pressformability.

As has been explained above, control of [$O_2$] content to 0.02% or less with Si and Al is a fundamental point of this invention. When [$O_2$] content is adjusted by the deoxidation agents, [$N_2$] content unavoidably becomes higher. In some cases, [$N_2$] can be $\geqq$ 0.003%. Such a high [$N_2$] content is not desirable for the quality of material and particularly in view of the strain aging property of a steel. It was recognized that the continuous annealing process including the over-aging treatment as above-mentioned was not yet sufficient to improve this defect. Accordingly, the present invention eliminates the said undesirable influences of [$N_2$] content by an improved full continuous said improved process comprises the following heat cycle; recrystallization heating to 680° to 900° C for from 30 to 180 seconds; slow cooling to 550° - 650° C from the above temperature; quenching to room temperature at a rate of at least 1,000° C/second; reheating and an over-aging treatment of 350° to 500° C for from 30 to 600 seconds; and finally, cooling down to room temperature and coiling. The above-mentioned heat cycle is characterized by an extremely rapid cooling rate of 1,000° C/second or more before the over-aging step and by making the final temperature in quenching room temperature and then performing an over-aging treatment after reheating from the above room temperature. The reason for this feature lies in precipitating a great amount of [$N_2$] dissolved in steel as carbide-nitride as well as solute [C] by combining the above-mentioned quenching step to room temperature with an ultra high rate, reheating step therefrom and then an over-aging step. Numerous experiments have shown that the upper limit of [$N_2$] content at which the effectiveness of the said improved heating cycle was recognizable was 0.008%. In other words, if [$N_2$] content exceeded 0.008%, quality of material deteriorated irrevocably, even if it was treated with the above improved heat cycle. Conversely speaking, so long as the above-mentioned [$N_2$] content does not exceed 0.008%, [$O_2$] content may be adjusted by the addition of Si and Al without considering the possible undesirable effects on material. The reasons for limitations in the above-mentioned improved heating cycle are given below.

Temperature at which quenching is started is one factor. When it exceeds 650° C, the yield point will become higher and its press formability will deteriorate; while if it is below 550° C, the strain aging property can hardly be expected to improve.

When the quenching rate is below 1,000° C/second, the precipitation of solute [$N_2$] to carbide — nitride will decrease.

Quenching to the room temperature and reheating is another factor. Nucleus formation for precipitation as carbide — nitride occurs during the reheating process, i.e., between the room temperature to 100° C.

Requirements other than the above-mentioned may be the same as those for a continuous annealing process including an over-aging treatment.

EXAMPLES

As follows.

Table (°, • - This invention steel)

| Steel No. | Chemical Composition (%) C | Si | Mn | P | S | O | Sol.Al | N | Hot-coiling temperature |
|---|---|---|---|---|---|---|---|---|---|
| 1 | 0.05 | 0.06 | 0.27 | 0.01 | 0.02 | 0.0482 | 0.002 | 0.0024 | 700 |
| °2 | 0.05 | 0.04 | 0.29 | 0.01 | 0.02 | 0.0181 | 0.003 | 0.0025 | 690 |
| °3 | 0.06 | 0.05 | 0.25 | 0.01 | 0.02 | 0.0138 | 0.003 | 0.0022 | 700 |
| °4 | 0.06 | 0.04 | 0.30 | 0.01 | 0.02 | 0.0082 | 0.003 | 0.0023 | 680 |
| 5 | 0.05 | 0.06 | 0.27 | 0.01 | 0.02 | 0.0482 | 0.002 | 0.0024 | 590 |
| 6 | 0.05 | 0.04 | 0.29 | 0.01 | 0.02 | 0.0181 | 0.003 | 0.0025 | 570 |
| 7 | 0.06 | 0.05 | 0.25 | 0.01 | 0.02 | 0.0138 | 0.003 | 0.0022 | 600 |
| 8 | 0.06 | 0.04 | 0.30 | 0.01 | 0.02 | 0.0082 | 0.003 | 0.0023 | 570 |
| 9 | 0.05 | 0.06 | 0.27 | 0.01 | 0.02 | 0.0482 | 0.002 | 0.0024 | 700 |
| 10 | 0.05 | 0.04 | 0.29 | 0.01 | 0.02 | 0.0181 | 0.003 | 0.0025 | 690 |
| 11 | 0.06 | 0.05 | 0.25 | 0.01 | 0.02 | 0.0138 | 0.003 | 0.0022 | 700 |
| 12 | 0.06 | 0.04 | 0.30 | 0.01 | 0.02 | 0.0082 | 0.003 | 0.0023 | 680 |
| °13 | 0.06 | 0.06 | 0.42 | 0.01 | 0.01 | 0.0099 | 0.003 | 0.0020 | 705 |
| °14 | 0.05 | 0.13 | 0.25 | 0.02 | 0.02 | 0.0095 | 0.004 | 0.0026 | 710 |
| 15 | 0.07 | 0.30 | 0.20 | 0.01 | 0.01 | 0.0072 | 0.002 | 0.0025 | 700 |

| Annealing cycle (cooling rate, starting temperature) | Mechanical Properties after temper rolling YP(Kg/mm$^2$) | TS(Kg/mm$^2$) | El(%) | YPEl after accelerated aging | Subject of test |
|---|---|---|---|---|---|
| I | 24.1 | 35.1 | 45.3 | 1.4 | Influences of [$O_2$] |
| I | 19.8 | 33.9 | 46.9 | 1.5 | |
| I | 18.2 | 32.6 | 47.4 | 1.3 | |
| I | 17.5 | 31.2 | 48.2 | 1.3 | |
| I | 26.0 | 36.2 | 45.2 | 1.6 | Influences by common coiling |
| I | 26.3 | 37.2 | 44.3 | 1.5 | |
| I | 25.8 | 36.3 | 44.6 | 1.5 | |

Table-continued (°, • - This invention steel)

| | | | | | | | | | | |
|---|---|---|---|---|---|---|---|---|---|---|
| | I | | | 25.5 | | 37.0 | | 46.3 | 1.8 | temperature |
| | III | | | 21.2 | | 31.2 | | 47.5 | 1.5 | Influences by high temperature coiling and batch-type annealing |
| | III | | | 19.8 | | 31.5 | | 46.8 | 1.6 | |
| | III | | | 20.0 | | 30.8 | | 47.9 | 1.5 | |
| | III | | | 19.8 | | 31.2 | | 47.0 | 1.3 | |
| | I | | | 18.7 | | 31.9 | | 47.8 | 1.4 | Influences of [Si] |
| | I | | | 20.2 | | 32.1 | | 47.3 | 1.5 | |
| | I | | | 23.0 | | 34.0 | | 46.5 | 1.4 | |
| °16 | 0.06 | 0.06 | 0.13 | 0.01 | 0.01 | 0.0080 | 0.004 | 0.0019 | | 710 |
| °17 | 0.05 | 0.05 | 0.23 | 0.01 | 0.01 | 0.0093 | 0.007 | 0.0023 | | 700 |
| 18 | 0.05 | 0.04 | 0.22 | 0.01 | 0.01 | 0.0100 | 0.010 | 0.0021 | | 700 |
| 19 | 0.06 | 0.05 | 0.35 | 0.01 | 0.02 | 0.0129 | 0.002 | 0.0028 | | 570 |
| 20 | 0.06 | 0.30 | 0.28 | 0.01 | 0.01 | 0.0053 | 0.035 | 0.0045 | | 510 |
| 21 | 0.05 | 0.08 | 0.25 | 0.01 | 0.02 | 0.0257 | 0.003 | 0.0029 | | 570 |
| °22 | 0.05 | 0.03 | 0.16 | 0.01 | 0.01 | 0.0097 | 0.003 | 0.0045 | | 700 |
| °23 | 0.05 | 0.03 | 0.16 | 0.01 | 0.01 | 0.0097 | 0.003 | 0.0045 | | 700 |
| °24 | 0.05 | 0.03 | 0.16 | 0.01 | 0.01 | 0.0097 | 0.003 | 0.0045 | | 700 |
| °25 | 0.05 | 0.03 | 0.16 | 0.01 | 0.01 | 0.0097 | 0.003 | 0.0045 | | 700 |
| °26 | 0.05 | 0.03 | 0.16 | 0.01 | 0.01 | 0.0097 | 0.003 | 0.0045 | | 700 |
| •27 | 0.05 | 0.03 | 0.16 | 0.01 | 0.01 | 0.0097 | 0.003 | 0.0045 | | 700 |
| •28 | 0.06 | 0.04 | 0.30 | 0.01 | 0.02 | 0.0082 | 0.003 | 0.0023 | | 680 |
| | I | | | 18.5 | | 32.3 | | 47.0 | 1.5 | Influences of [Sol.Al] |
| | I | | | 20.0 | | 33.0 | | 47.2 | 1.3 | |
| | I | | | 26.3 | | 35.9 | | 45.6 | 1.6 | |
| | III | | | 21.2 | | 31.3 | | 47.3 | 1.5 | Influences by common and batch-type annealing |
| | III | | | 19.2 | | 31.0 | | 47.0 | 0 | |
| | III | | | 20.5 | | 31.1 | | 47.0 | 1.6 | |
| | I | | | 19.8 | | 33.0 | | 47.2 | 2.8 | Effects by improved annealing cycle |
| | Without super-cooling | | | 19.7 | | 32.2 | | 47.4 | 2.1 | |
| | II (200° C/sec,600° C) | | | 20.0 | | 32.9 | | 47.3 | 2.0 | |
| | II (2000° C/sec,700° C) | | | 21.2 | | 34.2 | | 45.2 | 0.8 | |
| | II (2000° C/sec,500° C) | | | 20.7 | | 32.3 | | 47.1 | 2.8 | |
| | II (2000° C/sec,600° C) | | | 18.5 | | 32.4 | | 47.2 | 1.4 | |
| | II (2000° C/sec,600° C) | | | 17.3 | | 31.6 | | 47.9 | 1.2 | |

Table I shows examples concerning the present invention. The requirements not disclosed in the above Table are given below.

Hot rolling requirements:

Finishing temperature: 800° to 870° C

Finishing thickness: 2.0 to 3.2 mm

Cold reducing requirements:

Finishing thickness: 0.8 mm (0.5 mm for Steel 23)

Heat cycle:

Cycle I (continuous annealing cycle)

1. heating up from room temperature to 720° C for about 1 minute;
2. holding for 60 seconds at 720° C;
3. cooling from 720° C to 400° C at the average rate of 20° C/second;
4. holding at 400° C for 300 seconds;
5. cooling from 400° C to room temperature for about 40 seconds and coiling.

Cycle II (continuous annealing cycle)

1. heating up from room temperature to 720° C for about 1 minute;
2. holding at 720° C for 60 seconds
3. cooling from 720° C to 500°-700° C at the average rate of 20° C/second;
4. quenching from 500°-700° C to room temperature at the average rate of 200°-2,000° C/second;
5. reheating to 400° C for about 40 seconds;
6. holding at 400° C for 60 seconds; 7. cooling from 400° C to room temperature for about 40 seconds and coiling.

Cycle III (batch annealing)

1. heating up to 700° C for about 10 hours;
2. holding at 700° C for about 1 hour;
3. cooling from 700° C to room temperature for about 15 hours.

Temper rolling: 1.0 to 1.5%

Test requirements:

Aging requirements: accelerated aging of 38° C × 8 days

Tensile test piece: JIS No. 5.

The above Table I shows the results of the tests carried under the above requirements.

Steels 1 to 4 were checked for influence of $[O_2]$ content. The lower the $[O_2]$ content, the lower the YP value. As shown by Steel 2, YP is about 20 Kg/mm$^2$ when $[O_2]$ is less than 0.02%. As seen in Steels 3 and 4, the steels of low yield point such as YP $<$ 20 Kg/mm$^2$ are obtained when $[O_2]$ is $<$ 0.014%.

Steels 5 to 8 are examples of the same steels as those of Steels 1 to 4 coiled at ordinary coiling temperature of about 600° C. Entirely different from the said Steels 1 to 4, there is no effect of lowered $[O_2]$ content. This shows that the steels falling within the present invention composition range and treated by the continuous annealing process including the over-aging, are not as desised unless coiled at a high temperature in accordance with the present invention.

Steels 9 to 12 show examples where the same materials as the said Steels 1 to 4 (in respect of the composition and the coiling temperature) were treated by an ordinary batch-type annealing. As in the case of the said Steels 5 to 8, there are no effects evident of the lowered $[O_2]$ content and coiling at high temperature. This fact eloquently demonstrates that the composition range and the coiling temperature requirements of the present invention exert their effects fully only when the steel is treated by the continuous annealing process including over-aging and not when the steel is treated by the conventional batch-type annealing.

Steels 13 to 15 indicate the influence if [Si] content. Increased [Si] content is shown to raise the yield point. As in the case of Steel 14, when [Si] is <0.2%, YP becomes 20 Kg/mm². If [Si] is <0.1%, as in the case of Steel 13, the low yield point steel of YP < 20 Kg/mm² is sure to be achieved.

Steels 16 to 18 reveal the influences of [Sol.Al] content. The influence that [Sol.Al] exerts on YP is truly remarkable and as the former increases, the latter rises radically. This is due to Al precipitation and to the fine grain effect of AlN. In the process of the present invention, the fine grain effect of AlN is demonstrated particularly well, as illustrated in the example of YP value for Steel 18; [Sol.Al] content should be controlled even if the amount is very small. As the example of Steel 17 shows, when [Sol.Al] content is less than 0.009%, a YP value of about 20 Kg/mm² is obtained. If [Sol.Al] is decreased further to less than 0.005%, then the value of YP < 20 Kg/mm² is achieved, as the example of Steel 16 shows.

Steels 19 to 21 are the steels coiled at a low temperature of below 600° C and treated by a batch-type annealing. Steels 20 and 21 fall outside the present invention composition range. These steels indicate that they have the low YP values as described in the Table, although they have not been subject to the careful considerations of the present invention. These examples illustrate effectively the reasons for the lack of detailed investigations and considerations given for instance to the present invention. The batch-type annealing process did not require such experimentation.

Steels 22 to 27 were investigated for the continuous annealing cycle exerted on steel quality, particularly of strain aging property in the case where [$N_2$] content in steel is increased. The materials used in these experiments are all the same, with only the heat cycles differing. The common feature to these steels is the increased [$N_2$] content of 0.004%. The heat cycles for annealing are all different. The said Cycle I was used for Steel 22, while Cycle II was used for Steel 23 but with a different quenching pattern, that is, the pattern for quenching was directly cooling to the over-aging temperature of 400° C at 1,200° C/second from 700° C after recrystallization heating without super cooling.

The heat cycle applied to Steels 24 to 27 is the said Cycle II with varied quenching requirements as described in the Table. More in detail, the requirements for Steel 24 are: recrystallization heating, cooling to room temperature from 600° C at 200° C/second, and reheating to the over-aging treatment temperature. The quenching rate is characteristically slow as compared with more preferred improved cycle as mentioned above. The cycle for Steel 25 is: recrystallization heating, quenching from 700° C to the room temperature at 2,000° C/second, and reheating to the over-aging treatment temperature. The high temperature at which quenching is started characterizes the present cycle. The cycle applied to Steel 26 is characterized by the low temperature at which quenching is started; recrystallization heating, quenching from 500° C at 2,000° C/second, and reheating to the over-aging treatment temperature. The heat cycle for Steel 27 was chosen as a representative example of an improved heating cycle in the present invention. It comprises recrystallization heating, quenching from 600° C at a rate of 2,000° C/second to room temperature and reheating to the over-aging treatment temperature. In the above Table I, Steels 22, 23, 24 and 26 are shown to indicate radical strain aging even though their YP values achieve the desired values. Steel 25 is defective because of its high YP value although it achieves a less than 1.5% YPE1 recovery ratio which is preferred for an outer plate of an automobile body. From these results, it is understood that when [$N_2$] content in said steel is relatively high (e.g., about 0.004% or more) careful consideration of said continuous annealing process is required. Steel 27 is an example of a steel subjected to an improved continuous annealing process under such a careful consideration. Thus, Steel 27, which represents the improved cycle of the present invention, shows a small YPE1 recovery and low YP values. This steel is thus most suitable for an outer plate of an automobile.

Steel 28 is an example of a low [$N_2$] content (e.g., 0.003% or less) steel to which the said improved cycle was applied. The materials used are identical to that of Steel 4. YP is substantially the same as that for said Steel 4 and YPE1 is shown to be somewhat lower than that for Steel 4. However, this degree does not specifically call for the application of the improved cycle as shown for said Steel 27 and the Steels with such low [$N_2$] content will easily achieve the desired object by the continuous annealing process including ordinary over-aging treatment.

According to the above-mentioned Table I, the method of the present invention readily and stably provides continuous annealed steels exhibiting low yield point and high degree press formability by the synergetic effects of the control over composition, high temperature coiling in hot rolling stage and full continuous annealing process including over-aging treatment of the improved process in the case of relatively high [$N_2$] content.

We claim:

1. In a process of making a low carbon steel sheet for press-forming through a continuous annealing, an improved method substantially comprising the following treatment:

a. In steelmaking stage, the chemical composition of said low carbon steel is controlled as follows,
   C, 0.03% to 0.10%
   Mn, 0.10% to 0.60%
   P, 0.04% or less
   S, 0.05% or less
   Si, 0.2% or less
   Sol.Al, 0.005% or less
   $0_2$, 0.02% or less, by addition of Si and Al.
b. In hot-rolling stage after ordinary slabbing, a hot-roller steel strip is finished at 800° C or more and is coiled at a temperature of 650° C to 800° C.
c. In continuous annealing stage after ordinary pickling and cold reducing, a cold-reduced steel strip is subjected to the full continuous annealing process comprising the following steps,
   1. heating up within the range of 680° C to 900° C and holding for 30 to 180 seconds,
   2. cooling to 500° C or less with a rate of 10° C/second or more,
   3. over-aging treating within the range of 350° C to 500° C for 30 to 600 seconds,
   4. cooling to room temperature and then coiling.

2. The improved process as set forth in claim 1, wherein when [$N_2$] content in the controlling of the chemical composition is within the range of 0.003% to 0.01% the steel strip is subjected to the full continuous annealing process comprising the following steps:

a. heating up within the range of 680° C to 900° C and holding for 30 to 180 seconds, b. slow cooling to the range of 650° C to 550° C, c. quenching from the range of the above slow cooling temperature to room temperature with a rate of 1000° C/second or more, d. reheating from the room temperature to the range of 350° C to 500° C, e. over-aging treating at the above reheating-up temperature for 30 to 600 seconds, f. cooling to room temperature from the above over-aging temperature to room temperature and then coiling.

3. The process of claim 1, wherein Si content is from 0.1 to 0.02%.

4. The process of claim 1, wherein the $O_2$ content is up to 0.014%.

* * * * *